US005279091A

United States Patent [19]

Williams et al.

[11] Patent Number: 5,279,091

[45] Date of Patent: Jan. 18, 1994

[54] BUILDING ENCLOSURE ASSEMBLIES

[76] Inventors: Mark F. Williams; Barbara L. Williams, both of 945 Tennis Ave., Maple Glen, Pa. 19002

[21] Appl. No.: 904,598

[22] Filed: Jun. 26, 1992

[51] Int. Cl.[5] ..... E04B 2/78

[52] U.S. Cl. ..... 52/489; 52/241; 52/243; 52/508; 52/511; 52/481

[58] Field of Search ..... 52/508, 512, 489, 481, 52/483, 775, 511, 238.1, 241, 243, 262, 264, 265, 270

[56] References Cited

U.S. PATENT DOCUMENTS

| | | | |
|---|---|---|---|
| 1,296,936 | 3/1919 | Edwards, Jr. | 52/241 |
| 1,706,945 | 3/1929 | White | 52/508 |
| 2,059,483 | 11/1936 | Parsons | 52/775 |
| 2,164,261 | 6/1939 | Small | 52/508 |
| 3,016,116 | 1/1962 | Clevenger | 52/481 |
| 3,066,722 | 12/1962 | Gibson . | |
| 3,407,547 | 10/1968 | Doke et al. | 52/489 |
| 3,609,933 | 10/1971 | Jahn et al. | 52/489 |
| 3,623,290 | 11/1971 | Downing, Jr. | 52/241 |
| 3,753,325 | 8/1973 | Stanley et al. | 52/489 |
| 3,998,018 | 12/1976 | Hodges | 52/489 |
| 4,486,115 | 12/1984 | Rionda et al. . | |

*Primary Examiner*—Michael Safavi
*Attorney, Agent, or Firm*—George Tarnowski

[57] ABSTRACT

There are disclosed building enclosure assemblies consisting of panel members, a support means and a clip attachment means, for the construction of fixed or demountable, full or partial, interior or exterior walls, ceilings and floorings, which can meet code-mandated fire-rating and loading requirements, and in which differently sized and shaped panel members can be articulated to one another through the cooperative assembly of the panel members with the support means and clip attachment means.

13 Claims, 9 Drawing Sheets

BUILDING ENCLOSURE ASSEMBLIES

This invention relates to building enclosure assemblies, fixed or demountable, full or partial height, for horizontal and vertical applications, having the capability of providing a variety of architecturally aesthetic constructs. Wall partitions which are readily assembled and disassembled are referred to as demountable walls and structures of this type are well-known in the art. A wide variety of concepts have been employed for achieving demountable structures, a representative sampling of which can be seen in U.S. Pat. Nos. 2,154,520; 3,016,116; 3,027,605; 3,712,015; 3,729,883; 3,732,657; 3,908,328; 3,998,027; 4,106,251; 4,312,158; 4,566,241; 4,811,539; 4,833,849 and 5,060,434. While all of these systems vary in their precise configurations, demountable structures possess the basic components of a stud means for support of and attachment point for panel structures which are applied against the stud means and held in place by some form of attachment means, whereby there is formed a building structure, such as a hollow partition, a wall, a ceiling or a floor.

In each instance, the known building enclosure assemblies offer both advantages and disadvantages relative to each other and to certain recognized minimum requirements for such enclosures. A large number of factors enter into the identification of an ideal building enclosure assembly, among which are: ease of assembly and disassembly; minimum number of components; reasonable costs for components and assembly; strength and rigidity; fire/heat resistance, loading capability and satisfactory acoustical performance; flexibility and adaptability in meeting the physical constraints of the environment in which the assemblies are to be erected; ability to offer aesthetically pleasing choices for the finished assemblies.

One of the problems inherent in the hitherto known partition systems is that the components do not allow for the construction of other than a partition or wall comprised of a series of identically-sized panels fitted edge to edge and disposed between ceiling and floor, without variation as to size or juxtaposition of the individual panels. This creates an appearance which is simply functional, and does not allow for variations in panel articulations, in which panel members can be altered as to size and relation one to another to offer a range of visual appearances while unified within one system. Although functional enclosure assemblies, in both practical effect and visual appearance, have been, are and continue to be used, especially in large corporate settings, there is a definite and well-defined need for enclosure assemblies which have the practical effect of providing enclosures that delimit defined spaces and areas while at the same time offering the user and designer more visual choices. This is all the more so, when these goals can be readily accomplished using a minimum of labor, with the economical usage of standardized materials that are factory manufactured with a high level of quality control.

In addition to the aesthetic considerations, the ideal building enclosure assemblies must meet certain safety requirements (especially fire ratings, and horizontal and vertical loading), have the flexibility to be readily demountable for relocation and reassembly, as well as to allow for easy access to utility service distribution equipment contained within or behind the enclosure assemblies, such as for example electrical, communications and data processing wiring.

The conventional building systems generally utilize gypsum plaster wallboard panels because of considerations such as cost of manufacture, ease of construction, standardization in the industry, and so forth. But while gypsum plaster wallboard panels are substantially noncombustible, if sufficient heat is transmitted from the fire-exposed side to the unexposed side of the partition, the partition can fail to resist the spread of fire, heat or smoke. Standards have been developed to determine if the particular partition structure provides sufficient fire resistance to be termed "fire-rated." Such tests involve subjecting the partition to fire heat conditions on one side for predetermined periods of time. The ability of the partition to withstand such heat without exceeding specified temperatures on the opposite exposed side determines if the partition is satisfactory from the standpoint of resisting the spread of fire. Thereafter the partition is usually subjected to a hose stream test to simulate a condition which occurs when a fire is extinguished. In some situations, the fire rating requirements are even more stringent than those described above. Elevator shaft walls require, for example, at least a 2-hour rating. Where the wall system is "unbalanced", increasingly, code enforcement organizations are requiring that the rating be achieved from both sides of the wall. To pass such tests, heat transfer via the metal studs used in the construction of such walls must be substantially reduced.

Horizontal loading is another consideration in building enclosure assemblies, especially where the partitions are used to enclose shafts such as air return shafts, elevator shafts and stairwell shafts commonly found in multistory buildings such as offices and high-rise apartments. Destructive wind loading is of particular concern where the shaft is an air return shaft or an elevator shaft, where pressures or vacuums are developed which load the shaft wall up to 15 pounds per square foot in excess of atmospheric pressure.

Accordingly, improvement in the strength of any partition system is as important as an improvement in its fire-retardant properties.

It is, therefore, an object of the invention to provide building enclosure assemblies for the construction of interior walls, floors and ceilings and exterior walls, which can be readily assembled and disassembled, using a minimum of components and yet provide rigid and strong structures, which meet code mandated fire and reasonably anticipated horizontal and vertical loads.

It is a further object of the invention to provide building enclosure assemblies which have the flexibility to allow the articulation of differently sized and shaped panels to achieve esthetically pleasing enclosures.

It is an additional object of the invention to provide building enclosure assemblies which are specifically adapted to the use of a novel form of gypsum-based wallboard, such that the system is inexpensive, lightweight, extremely strong and rigid, and can be permanent or demountable.

Other objects and advantages will become apparent upon reference to the drawings and detailed description.

According to the invention, there is provided a building enclosure assembly comprising, in combination, a plurality of floor, wall or ceiling panel members, said members having a front surface and an obverse surface; a plurality of substantially L-shaped clip attachment means comprised of a leg and a foot, where said foot is fixedly attached to the obverse surface of said panel members, and said leg, being substantially perpendicularly disposed relative to the obverse surface of the panel member and having a proximal and a distal portion relative to the point at which said leg meets said foot, where said distal portion is a corrugated continuation of said proximal portion; and a plurality of support means each formed from a single sheet of material, comprising a web portion and a laterally expanded side portion integral with and connected to a margin of said web portion, said side portion having a cross section generally describing a hollow isosceles triangle having generally equal-length legs projecting from an apex adjacent the plane of said web portion and having the base of said triangle generally perpendicular to the plane of said web portion, said base having a plurality of slots along its length, said slots lying in a plane parallel to the plane of the web and being in direct alignment with and opposite the said apex, where the plurality of clip attachment means attached to the obverse face of the panel member are so spaced along an outer edge of the panel member as to correspond in alignment with the slots in the base and with the apex of the triangle of the support means, whereby the legs of the attachment means are adapted to pass through said slots and the distal corrugated portions of said legs are fixedly gripped within the apex of the triangle of the support means.

The building enclosure assembly just described can be used for the construction of hollow partition structures, such as walls, which serve to delimit open spaces. In such constructions, the support means of the invention will conventionally be metallic studs having the triangular side portions carried at one margin of the web, on which are mounted, in conjunction with the clip attachment means, the panel members or other suitable wallboards, this assembly forming one half of a hollow partition wall structure. Where the studs bear a triangular side portion on each web margin, there can be formed the other half of a hollow partition wall structure, together the two wall structure half portions thereby define a hollow partition wall structure comprised of two opposite and parallel, spaced-apart walls comprised of panel members. The triangular side portions of the studs confer strength and rigidity to the wall construction, but also provide a back-up to the edge portions of the panel members in contact with the base of the triangle of the stud, thereby resisting lateral loads imposed against the panel member joints. Further, when the enclosure assemblies of the invention are used to construct hollow wall partitions, by the proper arrangement and use of studs, the offsetting of the panel joints in the first wall surface, relative to the joints in the second opposite and parallel wall surface prevents the alignment of the panel member articulation joints of the opposite walls, reducing the potential for the direct and unhindered access of fire or water across the hollow wall via the joints and providing greater strength to the wall construction. Utilizing the support means of the invention, it is also possible to construct a wall against a pre-existing structure against which the support means can be fixedly mounted. The latter situation arises when the invention is used for the construction of a new wall over an existing wall structure, as well as in the construction of ceilings and floors.

By virtue of the co-action of the panel members and the attachment and support means of the invention, the building enclosure assemblies are able to conform to the requirements of code-mandated fire and reasonably anticipated horizontal and vertical loading for building enclosures. Moreover, the enclosures of the invention can be permanent or demountable, and can be used for the construction of permanent building enclosure including exterior walls, both bearing and non-bearing, floor and roof systems.

BRIEF DESCRIPTION OF THE DRAWINGS

FIG. 1 is a fragmentary, axonometric projection of the typical installation of a hollow interior wall in accordance with the invention. This particular installation illustrates the versatility of the system of the invention in creating an effect other than the conventional full height floor-to-ceiling paneling. Thus, in the presently illustrated installation, parallel rows 10 and 11 of gypsum-based or other suitable wallboard panels 12, form a wall in which adjacent panels abut along joints 13 to extend between a floor structure 16 and ceiling structure 15. The first two panels 12 surrounding door frame 14 are typical floor-to-ceiling height panels, such as are conventional in the art. The remaining panels 12 are illustrative of the variety of panel articulations that are possible with the system of the invention. Thus, it is possible to achieve a wainscoting effect, as exemplified by panels 12*c*, on top of which is formed a more intricate wall section consisting of small square panel sections 12*a* which surround two adjacent vertically rectangular panels 12*b*. The panels 12*a*, 12*b* and 12*c* can be covered with a variety of surface material in a variety of textures and colors to achieve a more individualized and aesthetically more pleasing appearance than that obtained by the conventional floor-to-ceiling adjacent vertical panel sections, such as 12. It is also possible to create additional design features which are adaptable to contemporary architectural trends. Thus, it is possible to create a sidelight or a clerestory with frame and glazing at sections 19 and 20 disposed between the ceiling 15 and the tops of panel sections 12*a* and 12*b*. If desired, it is possible to create a "jointless" wall appearance, such as is usually obtained in conventional taped and bedded drywall construction, by use of the building enclosure assemblies of the invention. In the latter case, after mounting of the panels, there is installed within the length of the joints 13 a "drawstring" followed by conventional taping and bedding of the joint, providing a "jointless" surface appearance. If it becomes necessary to demount such a wall, the "drawstring" can be pulled through the taping and bedding, revealing the joint and permitting panel demounting. The panel can then be reused in subsequent installations. The floor track 17 and the ceiling track 18 serve to maintain the support means of the invention in proper alignment vertically and relative to each other. Optional ceiling trim members 21 and baseboard trim members 22 extending along the length of the ceiling and floor, respectively, may be provided. A plurality of support means 23 are positioned between the two rows 10 and 11 as more fully described hereinbelow.

Referring now to the remaining Figures, the detailed structure of the support means, the clip attachment means and their inter-relationships with each other and the panel members are illustrated, in which numbers identical to those used in other Figures refer to identical features. Thus, in FIG. 2, the support means 23 of the invention, which is characterized by being formed, by preference, from a single sheet of metal, has a web portion 24 and at least one, but as illustrated, two side portions 25. The latter are parallel to each other, integral with the opposite margins of the web 24 and extend the length of the support means 23. As seen in FIG. 2, the side portions 25 have the general configuration of a hollow isosceles triangle which is formed from a series of distinct elongated segments along each edge of the sheet, wherein the first segment 26 forms one generally equal-length leg of the isosceles triangle, a second segment 27 forms the base of said triangle and third segment 28, which forms the other equal-length leg of the triangle and which meets the point at which the first segment 26 angles off from the margin of web portion 24 to form the apex 29 of the triangle. The second segment 27 or base is substantially perpendicular to web portion 24. Alternatively, as illustrated on one side portion of the support means 23 in FIG. 2, the side portions can be so formed that the segment 28 incompletely meets the point at which the first segment 26 angles off from the margin of web portion 24 whereby apex 29 does not result in a closed triangle, but there is left an opening 30, at apex 29, whose co-operation with other features of the assembly of the invention is discussed hereinafter.

FIG. 3 illustrates the additional features of the support means required for its utilization in the enclosure assembly of the invention. Thus, the base 27 of the side portion 25 is perforated with elongated slots 31, which as seen in this illustration, as well as in FIG. 2, lie in a plane parallel to the plane of web 24. These slots are also in direct alignment with and opposite to the opening 30 at the apex 29, when such an opening is provided in the support means. The dimension of the opening 30, which is defined by the web portion 24 and the end of segment 28, is narrower than the lateral dimension of slots 31. As additional features, the base 27 of the triangles of the support means can be further perforated with openings 33, which can serve to accept shelving bracket means for ease of mounting shelving on a completed enclosure assembly. Openings 34 can be perforated in web portion 24 in order to provide means for accessing and manipulating electrical, communications and data processing wiring, as well as gas and water lines, which are to be contained within the enclosure assemblies of the invention.

FIG. 4 illustrates an elevation view of the support means 23 of the invention, showing the spacing of the elongated slots 31 and optional openings 33 along the length of base 27 of a side portion of the support means.

FIG. 5*a* illustrates the L-shaped configuration of the clip attachment means 35 used in the invention. The embodiment in this illustration shows the attachment means 35 to be a unit comprised of a foot portion 36 and a leg portion 37 integral with the foot portion 36. The foot portion 36 is adapted to be fixedly attached to the obverse surface 38 of a panel member 12 along an edge thereof. Once foot 36 is so attached, leg 37 lies in a plane perpendicular to both the foot 36 and the obverse surface 38 of the panel member 12. The leg 37 has a configuration defined by two distinct portions. A portion 39 proximal to the point 40 whereby leg 37 perpendicularly meets the foot 36 and a portion 41 distal to said meeting point 40, which is a corrugated continuation of the proximal portion 39. FIG. 6 illustrates an embodiment of the clip attachment means 35 illustrated in FIG. 5*a*. In FIG. 6, the foot 36 has formed therefrom a plurality of nail-like teeth 42, which are of approximately uniform length and depend in a direction substantially perpendicular to the foot 36. The formation of such nail-like teeth 42 from the foot 36 is well-known in the art. In FIG. 5*b*, the leg 37 is as described in the discussion of FIG. 5*a*, with the additional feature that leg 37 has an extension 43 which lies in the same plane as leg 37 and which extends in a direction opposite from the leg from the point 40 where the leg and foot meet. As can be seen in the uppermost clip in FIG. 7, this extension 43 permits clip 35' to be properly aligned with the outer edge of panel member 12, by having its inner surface 43*a* in flush contact with and bearing against said panel member edge. This prevents the possibility that through inadvertence or lack of skill or experience, the clips may be attached in such a manner that legs 37 do not lie in a plane parallel with the edge of the obverse surface of panel members 12. In a further variant, extension 43 co-operates with and seats into a corresponding recess provided therefor in the outer edge of the panel member. This latter feature is also illustrated in FIG. 7, which shows two clip attachment means, 35 and 35', utilizing the leg embodiments illustrated in FIGS. 5*a* and 5*b*, respectively, attached to two articulated panel members 12. Thus, each panel member 12 has attached to its obverse surface 38 a clip attachment means, 35 and 35', in which the foot 36 of each is fixedly attached thereto by the impalement of teeth 42 into panel member 12, and whereby leg 37, carrying proximal portion 39 and distal corrugated portion 41, lies in a substantially perpendicular plane to both foot 36 and obverse surface 38. The legs 37 of clips 35 and 35' can be of equal length with foot 36 or, as seen in FIG. 6 the leg 37 can be offset to one end of an elongated foot 36, so that in either case, when two panel members are to be articulated one to the other as shown in FIG. 7, the clips 35 and 35' attached at the edges of the panel members 12 will be so positioned that they will abut each other adjacently with one clip 35 being turned 180° relative to the other 35' prior to being attached to the panel member. The result of this disposition of the clips relative to each other is that the legs 37 now lie in the same vertical (or, as the case may be, horizontal) plane, and spaced apart so as not to interfere with each other when the panel members 12 carrying them are articulated one to the other. In FIG. 7, as already mentioned in the discussion of FIG. 5*b*, supra, the leg extension 43, can also co-operate with and seat into a relief of recess 44 which is specifically provided for extension 43 in the outer edges of panel members 12. The co-operation of extension 43 with this recess or relief 44 not only permits the precise attachment of the clips along the outer edge of panel members 12, but also permits the edges of panel members 12 to be abutted so closely as to form a virtually "closed" joint.

A further embodiment of clip 35 is illustrated in FIG. 8. In this view, modified clip has a foot in the form of a strap 36*a*, which has a central portion 45 defined by a stepped shouldered projection which is substantially parallel with the two outer portions 46 of strap 36*a* by which it is attached to the obverse surface 38 of the panel member 12. In FIG. 8, the strap 36*a* is attached to panel member 12 by the same arrangement of impaling teeth 42, as illustrated in FIGS. 6 and 7. The leg of this modified clip embodiment is in the form of a separate insert 47, wherein the leg portion 37, with its proximal portion 39 and distal corrugated portion 41 is identical to that illustrated in FIGS. 6 and 7, while the additional feature of this embodiment is the U-shaped member 48, which is adapted to co-operate with and fixedly fit into and through the space formed between the obverse surface 38 of panel member 12 and the inner surface of the central portion 45 of strap 36*a*. This U-shaped member is so formed that the two side portions which form the "U" are spaced apart by a distance greater than the space that is formed by the interior surface of central portion 45 and the obverse surface 38 of panel member 12. When U-shaped member 48 is inserted into and through said space, the side portions of said member bear out against the surfaces which define that space, thus retaining insert 47 within said space. The resultant effect is substantially identical to that achieved by the embodiment in which leg 37 is fixedly and permanently attached to foot 36, as is illustrated in FIGS. 5–7. Additionally, in order to provide for the correct parallel alignment of insert 47 relative to the outer edge of panel member 12, insert 47, as illustrated in FIG. 8, optionally can be further provided with a leg extension 43, which as in the embodiment in FIGS. 5*b* and 7, by itself or in co-operation with a relief or recess provided in the edge of the panel member, helps to maintain proper alignment of the insert 47 and hence of leg 37 relative to the edge of panel member 12.

Figure 5A:
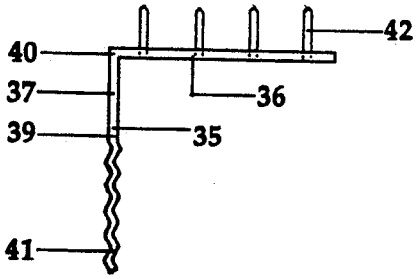
FIG. 5*a* is a sectional plan view of an embodiment of the clip attachment means used in the enclosure assemblies of the invention.
Figure 5B:
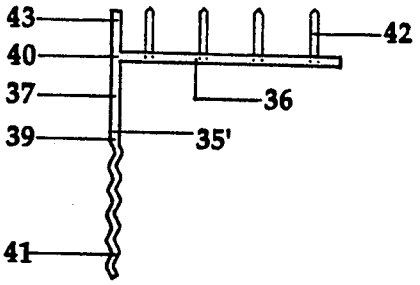
FIG. 5*b* is a sectional plan view of a further embodiment of the clip attachment means illustrated in FIG. 5*a;*
Figure 7:
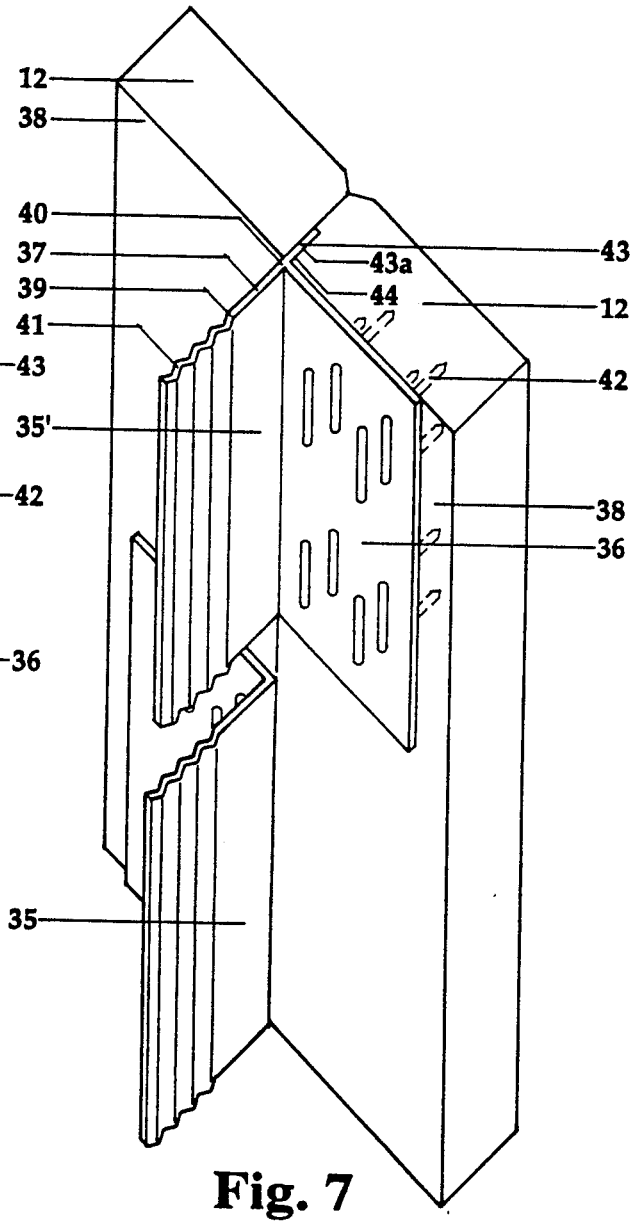
FIG. 7 is a further axonometric projection illustrating the arrangement of embodiments of the clip attachment means at the joint formed by the articulation of two panel members.
Figure 8:
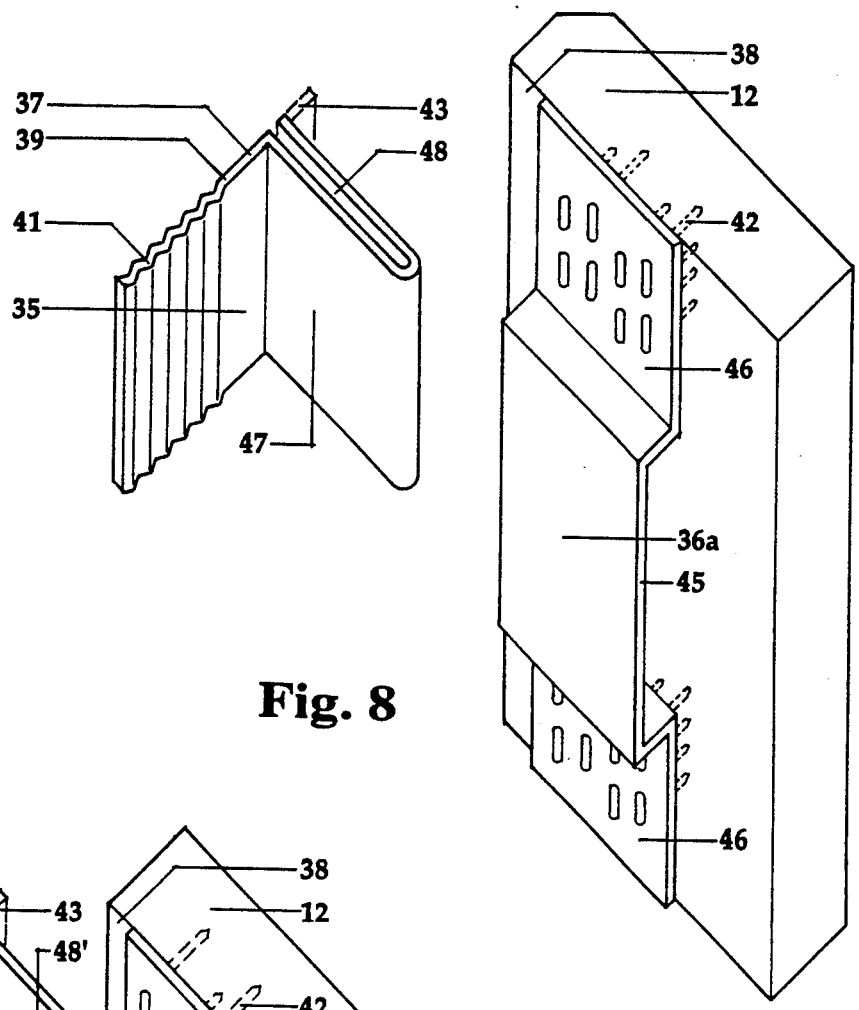
FIG. 8 is an axonometric projection illustrating an additional embodiment of the clip attachment means used in the invention.
Figure 9:
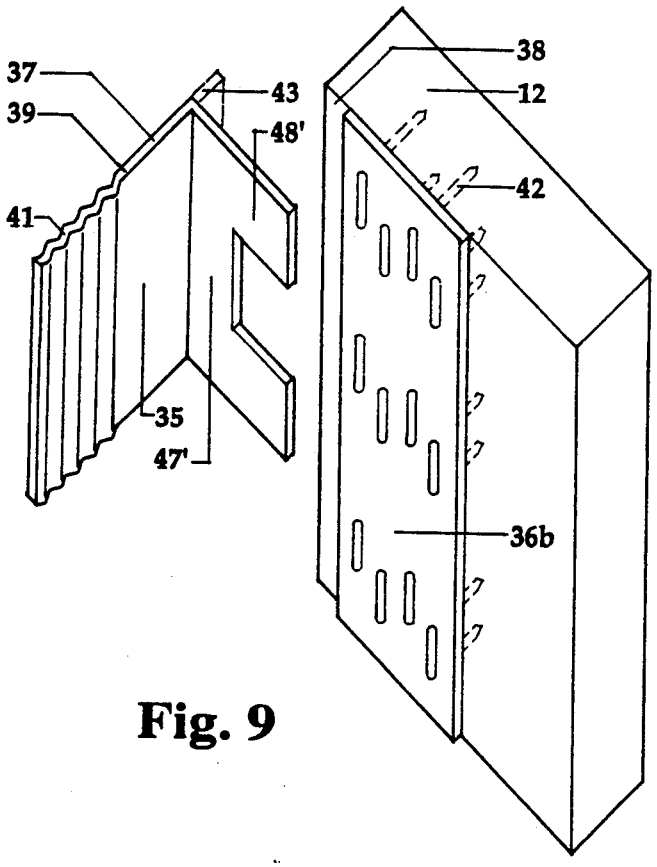
FIG. 9 is an axonometric projection illustrating a further embodiment of the clip attachment means of FIG. 8.

Another variant of modified clip is illustrated in FIG. 9, wherein the foot is now in the nature of a plate 36*b* having multiple rows of impaling teeth so formed that between the top and middle row of teeth, and between the middle and bottom row of teeth there are provided toothless areas which correspond in width with the two legs of the tang 48' carried by separate insert 47'. This insert 47' is a variant of the insert 47 of FIG. 8, where the U-shaped member 48 is now replaced by tang 48'. In operation, as foot 36*b* is being attached to the obverse surface 38 of a panel member 12, the tang 48' is offered into position so that the legs thereof are positioned in the toothless areas of plate 36*b*, which is then brought fully into contact with the obverse surface 38 of panel member 12, thereby fixedly gripping tang between itself and the panel member. As in the embodiment of FIG. 8, insert 47' has leg portion 37 with a proximal portion 39 and distal corrugated portion 41 and optional leg extension 43, all of which are identical to and function in the same manner as do those features in the embodiments in FIGS. 5*b*, 7 and 8.

The embodiments of clip attachment means of FIGS. 8 and 9 possess several advantages when employed in the enclosure assembly of the invention. By virtue of having a separate leg portion, the embodiment of FIG. 8 makes it possible to manufacture panel members with pre-attachment of the foot having the stepped shouldered projection as its central portion. The panel members so equipped at the factory level or at some other intermediate point can then be shipped to the ultimate job site, where the leg inserts can be installed as the enclosure assembly is erected, This eliminates the step of attaching the entire clip attachment means at the job site. Moreover, clip attachment means with separate leg portions in the form of the insert allow panel members just described to be shipped without the danger of damaging the clip attachment means, as would be the case if the integral unit clip attachment means were installed at the factory level. In like manner, in the case of the clip embodiments having separate leg inserts, panel members, as illustrated in FIGS. 8 and 9, whether newly manufactured or recently demounted, can be more conveniently stored when the legs of the clip means are not integral with the foot.

Figure 6:
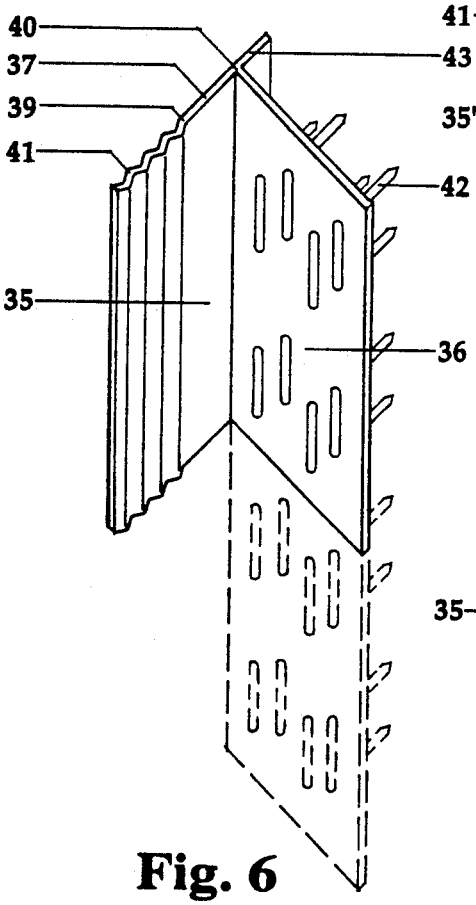
FIG. 6 is an axonometric projection of an embodiment of the clip attachment means used in the invention.
Figure 10:
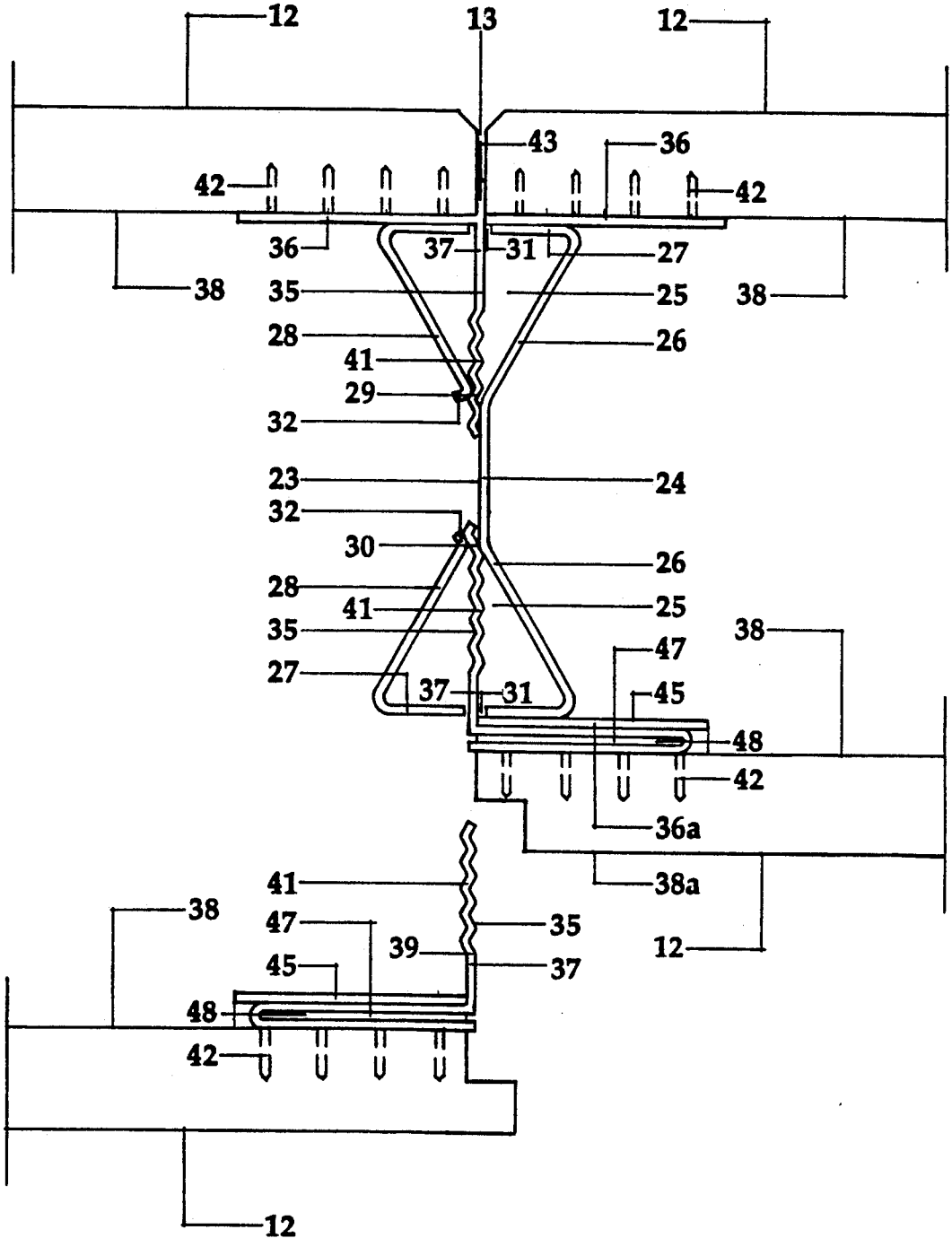
FIG. 10 is a cross-sectional view illustrating the structure of the support means and the clip means and their co-operation in the assembly of the invention.

Referring now to FIG. 10, there is illustrated a cross-sectional view of a hollow wall comprised of opposite and parallel rows of articulated panel members 12, which are mounted on and secured to support means 23 via the various clip attachment means specifically discussed, supra. The following description relates to a building enclosure assembly of the invention utilizing the clip attachment means embodied in FIGS. 5–7. However, another of the clip attachment means embodiments, which has already been discussed and which is illustrated in FIG. 8, is also exemplified in FIG. 10, but no additional description of its use is provided, as this will become apparent from the previous discussion of this embodiment and the immediately following discussion with respect to the use of the clip attachment means earlier illustrated in FIGS. 5–7. According to the invention, the foot 36 of clip attachment means 35 is attached to the obverse surface 38 of panel members 12 by nail-like teeth 42, the clip 35 being aligned to the edge of panel member 12 via leg extension 43. The leg 37 of clip 35 is passed through elongated slot 31 in the base 27 of the side portion 25 of the support means 23 and the obverse surface 38 of panel member is brought into flush contact with base 27, whereby the distal corrugated portion 41 of leg 37 passes through the apex 29 (or opening 30 at the apex) of the triangular side portion 25 and is fixedly retained therein by the gripping action exerted on distal portion 41 by the end of triangle equal-leg segment 28 and web 24. While the gripping action exerted on distal corrugated portion 41 fixedly secures panel members 12 against the support means 23, the co-operation of the enclosure assembly components also permits disassembly or demounting, as necessity dictates. In the latter instance, a thin-bladed instrument can be passed through joint 13, through slot 31 to pry leg segment 28 away from web portion 24, expanding the dimension of the apex or of opening 30, thereby releasing distal corrugated portion 41 from being gripped therein, allowing leg 37 to be withdrawn through slot 31 and thus releasing the panel member 12 from its position of mounting onto support means 23. In order to facilitate this demounting process, a "turn-out" 32 can be formed on the very end of leg segment 28 where it approaches web portion 24 to form apex 29. The "turn-out" avoids the possibility of a corrugation on distal portion 41 of leg 37 from being caught on the otherwise unrelieved sharp end of leg segment 28 as well as serving to add stiffness to the terminal edge of leg segment 28. As shown in FIG. 10, the particular assembly configuration illustrated provides for the construction of a symmetrical hollow wall in which the joints between panel members in one half-wall are in alignment with those in the opposite half-wall.

Figure 11:
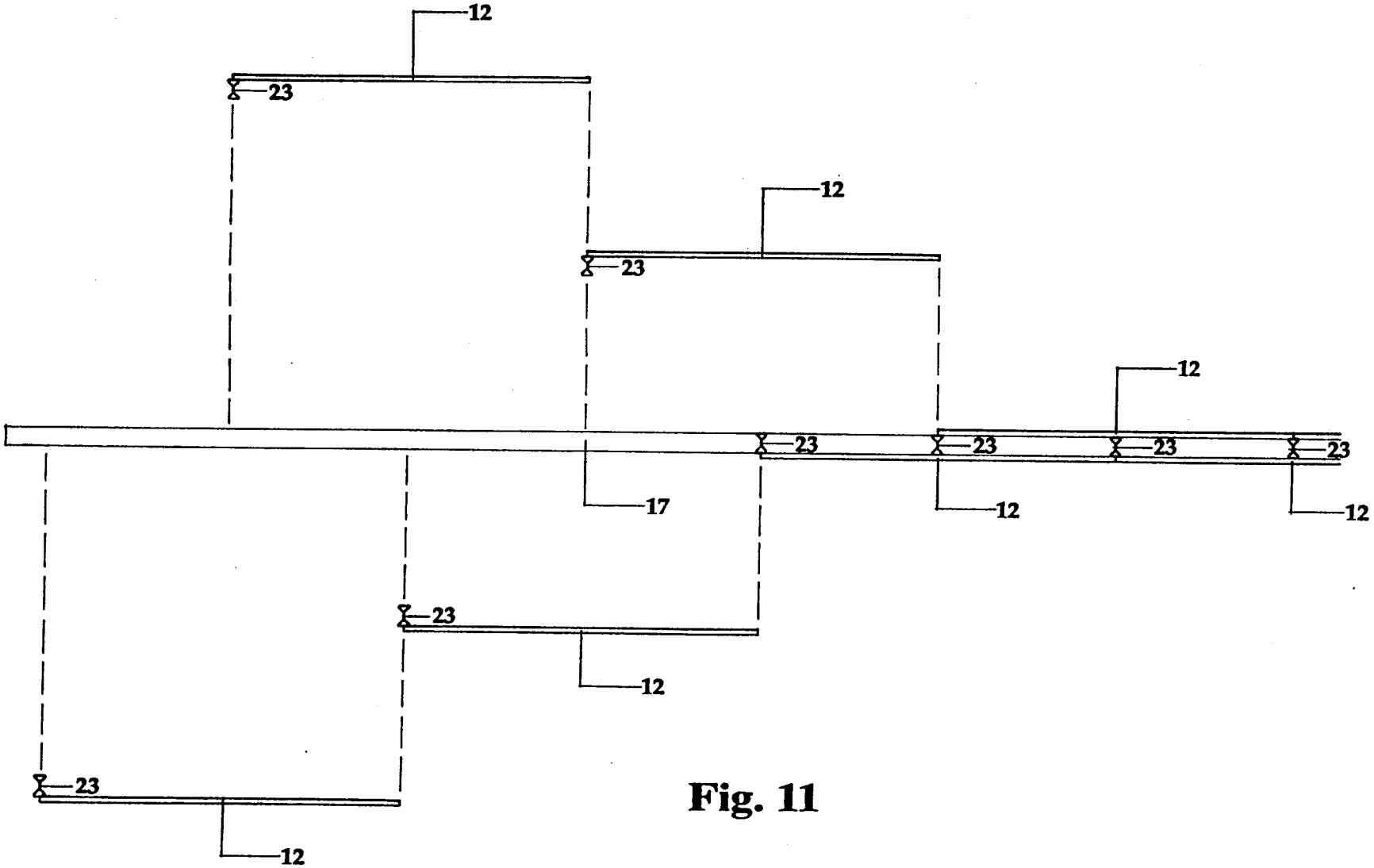
FIG. 11 is a floor plan view of the manner of staggering joints in the opposite walls of a hollow wall partition erected using the enclosure assembly of the invention.

The support means, clip attachment means and panel member, in their co-operative aspect, also provide the key to the fire-resistance capabilities of the building enclosure assemblies of the invention. The panel members, which are made of a gypsum-based material, are highly fire-retardant, so that any enclosure, be it a wall, ceiling or floor, constructed of the enclosure assembly of the invention, will be substantially fire-resistant in its broad surface aspect. The main point at which conventional partition structures fail in the face of a fire is at the joints where adjacent panel members meet. In the enclosure assembly of the invention, the high fire-rating capabilities of the invention are achieved by attention to the positioning of joints in the erection of hollow partition walls using the enclosure assemblies of the invention Thus, in the erection of a hollow wall partition consisting of opposite and parallel walls, it is possible to so assemble the respective walls that the formation of a joint in one wall does not result in the formation of a joint in the opposite wall which would be in direct alignment with the joint in the first wall, i.e., the joints in one wall are staggered relative to the joints in the opposite and parallel wall. This can be more readily appreciated by referring to FIG. 11, where the floor plan view clearly illustrates the way in which a staggered joint is formed in the construction of opposite walls of a hollow partition. This arrangement does not permit the heat of a fire to breach a hollow wall by conduction from one joint, across the support means to an opposite joint, in the event of the failure of the first wall to resist the conduction of the heat of the fire via the support means.

Referring back to FIG. 10, there is illustrated therein a further embodiment of the panel member 12 used in the enclosure assembly of the invention, which confers additional fire and lateral load resistance capabilities to the assembly. In this embodiment, the edges of panel members 12 are formed so that a portion of the obverse surface 38*a* edge and a portion of the front surface 38*a* edge of the respective panel members are rabbetted, so that when the edges of the two panels are articulated at a support means 23, and are mounted onto the latter by means of a clip attachment means 35, there is formed a "shiplap" joint, which further inhibits the breaching of fire from one wall surface, across the joint to the opposite wall.

A key feature of the enclosure assembly of the invention is the use of either a gypsum-based or a non-gypsum-based material for the panel members. The typical gypsum plaster board which is currently the standard material in the construction trade can be used in the enclosure assembly of the invention. The gypsum-based material of the invention also embraces gypsum fiber board and gypsum particle board, which are commercially available and are used by preference in the invention. Additionally, the invention also contemplates the use of commerically available, non-gypsum-based boards for the panel members.

Gypsum particle board is a modification of the gypsum fiber board discussed immediately hereinafter. Its properties are more similar to that of conventional particle board and is therefore more properly to be compared to the latter than to plaster. It is, however, compatible with the methodology and objects of the enclosure assemlies of the invention and thus is to be considered as equally useful for all applications of the invention in which gypsum fiber board is utilized.

Gypsum fiber board is a compressed semi-dry process composition consisting of plaster of paris, waste paper, additives to regulate setting time and water. The finished material is a fire-resistant building board of homogeneous composition having much higher bending strength as compared to conventional plaster board. This is especially true of the length direction bending strength of gypsum fiber board, which is twice that of plaster board. The random orientation and uniform distribution of fiber in gypsum fiber board makes it possible to obtain sharp edges free of defects upon sawing, milling, planing or drilling. Further, the homogeneity allows the boards to be readily sanded and makes them suitable for lamination with plastic sheets or wood veneers.

The gypsum-based panel members of the system of the invention are especially adapted for the creation of very tight panel joints by the employment of the embodiment in which the clip attachment means are provided with a leg extension which co-operates with and is seated into a relief or recess provided in the edge of a panel member, as was discussed, supra, in reference to FIGS. 6,7,8 and 9. Thus, the gypsum fiber panel members are strong enough to be subjected to the operation used to create the relief or recess in the edges of the boards required by the invention.

The strength of gypsum fiber panel members also permits the invention to be used in those instances in which wind-loading is a factor, for example in partitioning open shafts such as air return shafts, elevator shafts and stairwell shafts, as well as in exterior wall applications. In the latter case, the system of the invention can be used to erect permanent bearing or non-bearing walls where the walls constructed with the system of the invention are clad with suitable building materials to meet all code-mandated requirements.

The construction of a given enclosure assembly proceeds by fitting support means onto panel members via the use of the clip attachment means, with adjacent panel members being mounted adjacent each other. Since gypsum-based panel members can be manufactured in any desired size and geometric design, the panel members can be fitted and arranged one to the next in any desired pattern. The support means necessary to effect the joining of adjacent panels can be custom cut to any desired length to accomodate the chosen adjacent panel configuration.

Figure 12:
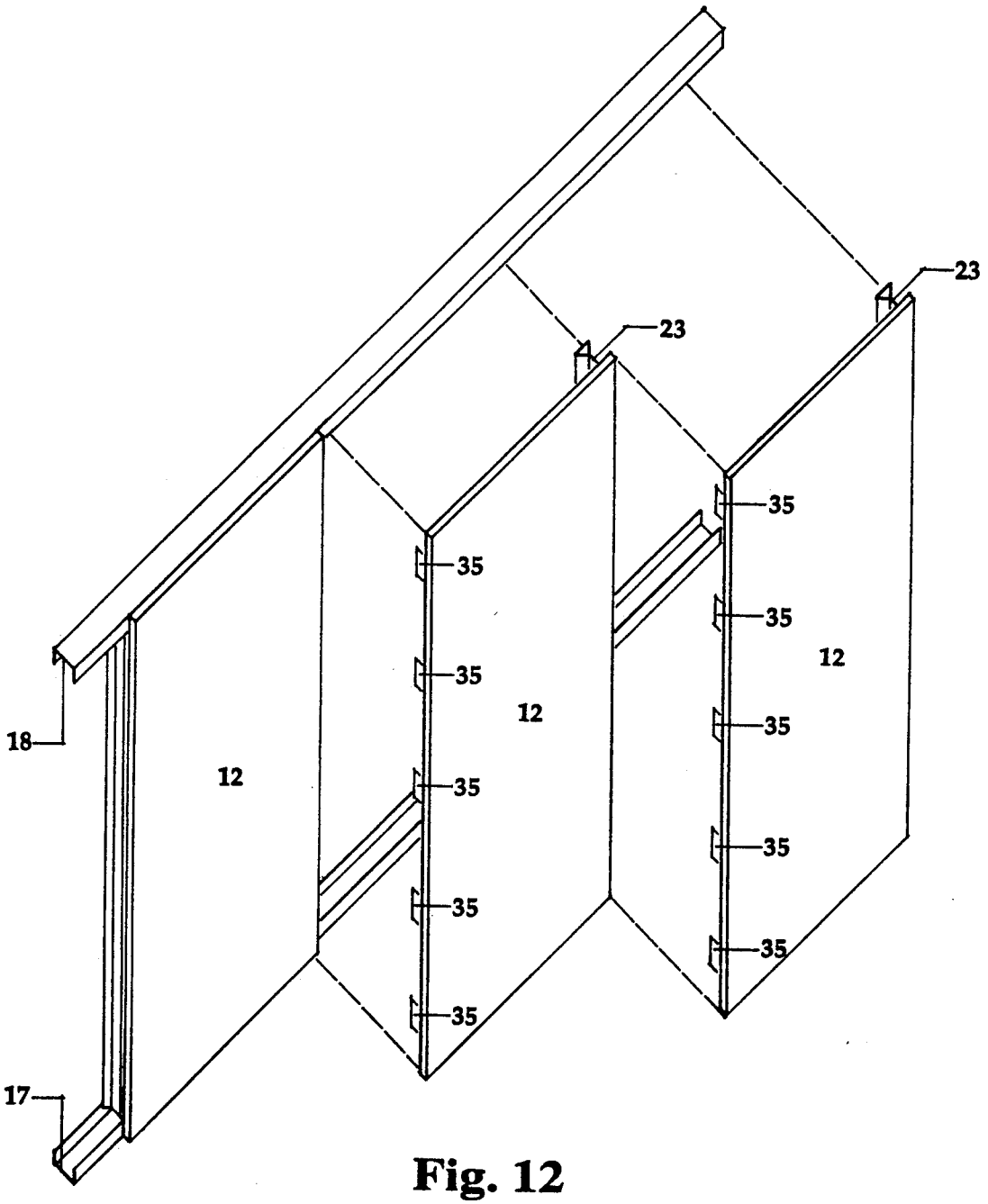
FIG. 12 is an axonometric projection illustrating the means for carrying the support means of the assembly of the invention in proper and fixed vertical alignment in the erection of a hollow wall partition.

In the erection of a hollow wall partition to delimit an open space by use of the enclosure assembly of the invention, it is necessary to provide for means of fixedly maintaining the support means in proper level vertical and/or horizontal alignment and appropriately spaced apart each from the next. The support means can be attached directly to fixed structural members, such as existing floors, ceilings and walls, or to track means themselves attached to fixed building structural members. Referring now to FIG. 12, the support means 23, for example, are carried between and held in position in track means, such as a floor track 17 and a ceiling track 18, which are configures as upwardly and downwardly, respectively, facing continuous open-channel structures, whose parallel sides define a channel of a width slightly larger than the triangle base-to-triangle base dimension across the support means 23. Tracks 17 and 18 are themselves attached to fixed building structural members, such as the floor and ceiling of the space to be partitioned by conventional means used in the enclosure assembly art.

Figure 13:
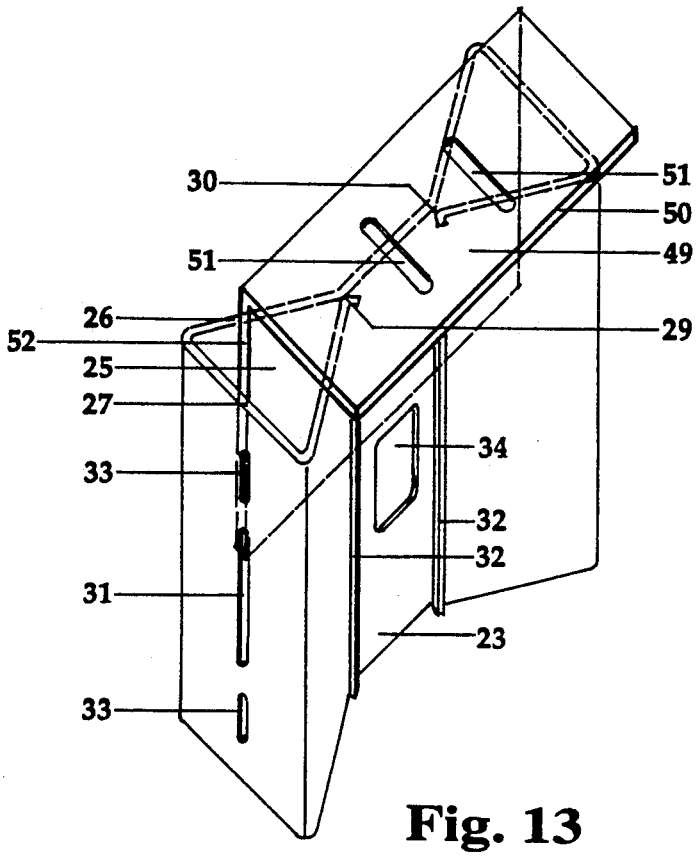
FIG. 13 is an axonometric projection illustrating a bracket used with the support means of the invention and its co-operation therewith.
Figure 14:
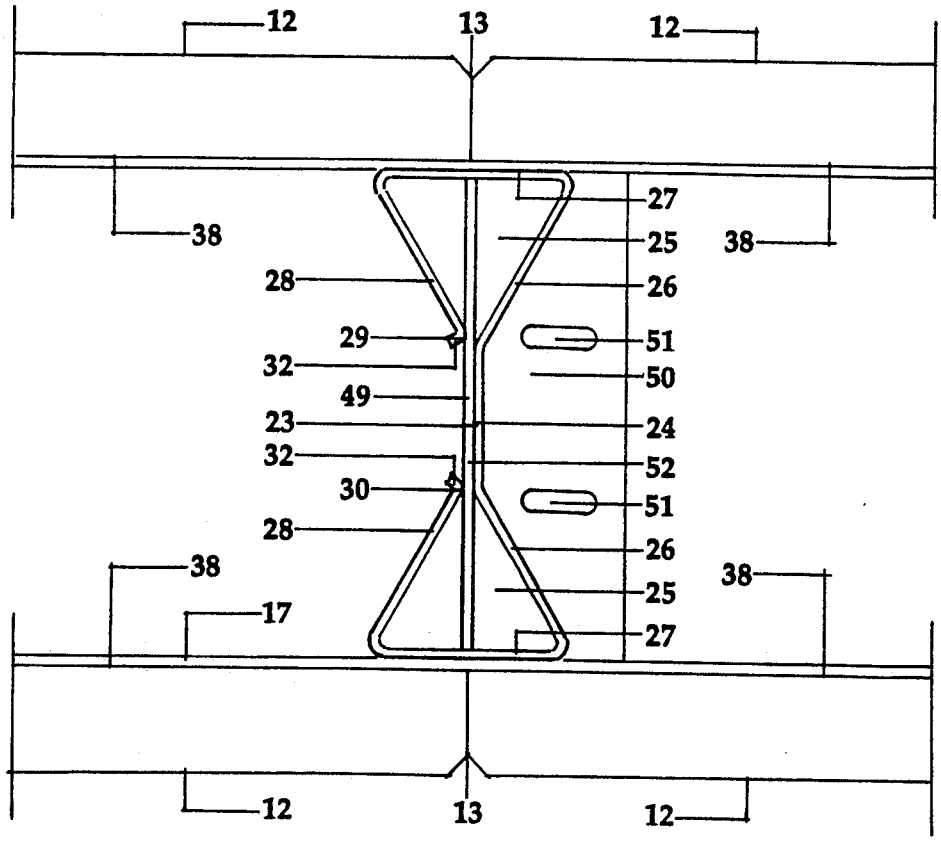
FIG. 14 is a cross-sectional view of a hollow wall partition erected using the assembly of the invention, looking down onto a floor track upon which the partition has been assembled, and illustrating the use of the bracket with the support means.

The support means 23 are themselves attached to the tracks 17 and 18 by the detail shown in FIGS. 13 and 14. In FIG. 13 there is illustrated a 90° bracket 49, one leg 50 of which has openings 51 formed therein while the other leg 52 is adapted to be inserted into and to be gripped within the apices 29 of the triangular side portions 25 of support means 23 or openings 30 at the apices. A support means 23 having a bracket inserted at both the floor and at the ceiling end thereof as just described, is set into place between the floor track 17 and ceiling track 18 as illustrated in FIG. 12. The cooperation of the support means 23, bracket 49 and floor track 17 is illustrated in FIG. 14, which is a cross-sectional plan view of a wall partition looking down onto the floor track 17. The brackets 49 are adjusted to come into full contact with the floor and ceiling tracks, and the brackets are fixedly attached to those tracks via openings 51 using conventional fasteners, such as nails, screws, bolts and the like. These brackets permit the support means to be fixedly attached to the floor and ceiling tracks and also permit support means of a given length to be fixedly attached where minor variations in floor to ceiling height may occur, by adjustment of the brackets outwardly from the support means to fully meet the floor and ceiling tracks.

The support means 23, and the above-described bracket 49, are also capable of providing, in combination, a framework upon which can be erected a conventional, permanent wall, ceiling or floor utilizing either conventional gypsum board, gypsum fiber board or other wallboard products. Thus, for example, a hollow wall partition can be readily assembled by erecting a series of support means 23 using brackets 49 either between floor and ceiling tracks, 17 and 18, or simply between the existing floor and ceiling structural elements. The resulting framework can then be clad using panels of gypsum board, which can be attached by use of conventional attaching devices, such as screws, which pass through the gypsum board and are fixedly retained within the laterally expanded side portion of the support means, such as by use of the elongated slots 31 or openings 33 of base 27 and apex 29 (or opening 30 at the apex) of the support means, all of which lie in the plane of the centerline of the support means. However, appropriate attaching means, such as for example, dry wall screws, can also be driven through base 27 of the support means at points offset from the centerline. In this case, the attaching means would be driven through base 27 itself and would also be driven through and anchored in the support means triangle segments 26 and/or 28. The latter attachment means is possible by use of an appropriate gauge of metal to form the support means of the invention. This use of elements of the building enclosure assembly of the invention results in enclosure constructs which are permanent, in the sense that they can not be readily disassembled. However, when this is the desired goal, the combination of elements just described does offer a means for rapidly and inexpensively erecting a conventional "permanent" gypsum board-based building structure, such as a hollow partition, a wall, a ceiling or a floor, singly or in conjunction with demountable partitions utilizing the same components.

Figure 1:
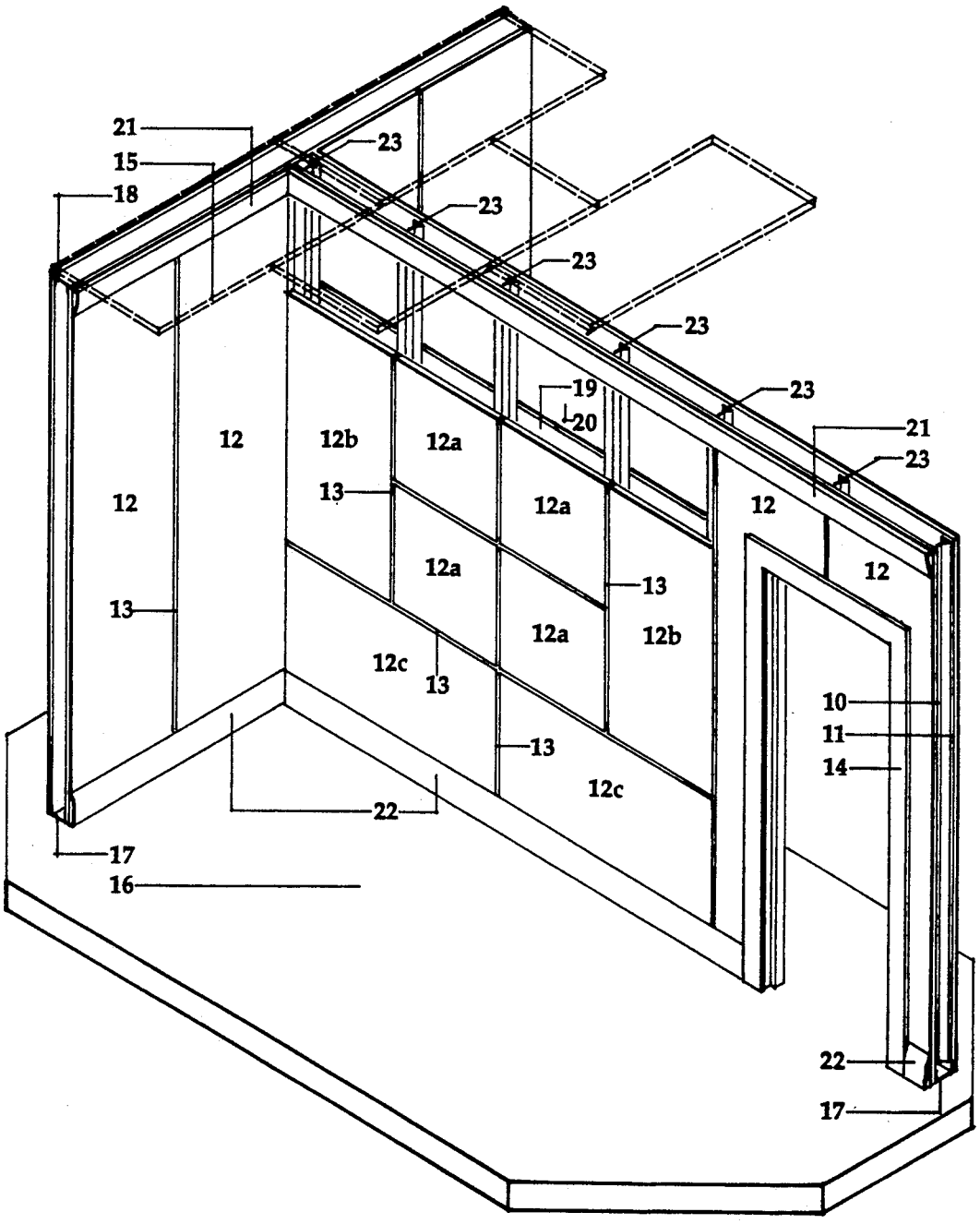
FIG. 1 is a fragmentary, axonometric projection of a hollow interior wall installed in accordance with the present invention.
Figure 2:
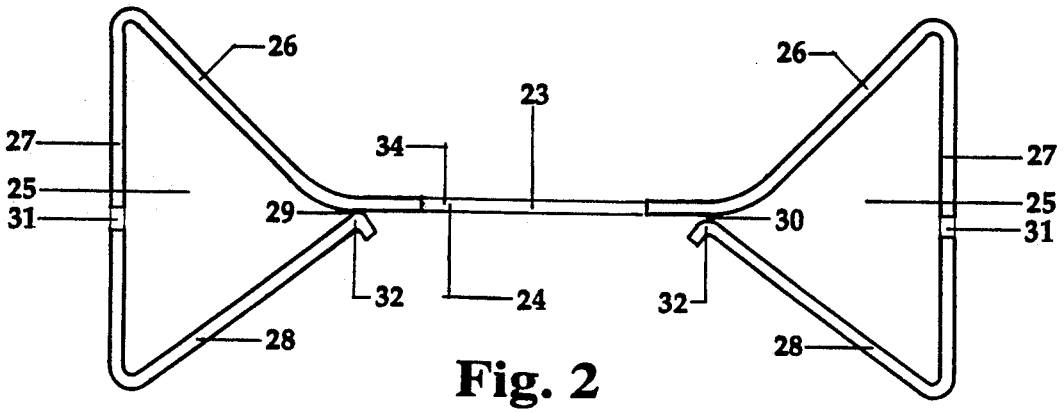
FIG. 2 is a sectional plan view of the structure of the support means of the invention.
Figure 3:
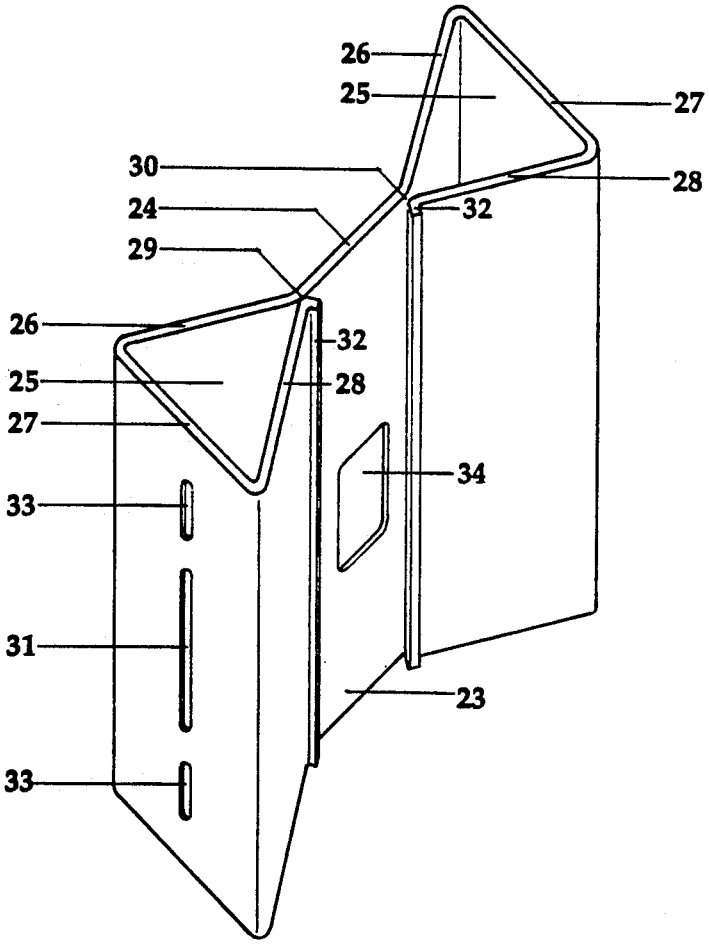
FIG. 3 is a partial axonometric projection of the support means of the invention.
Figure 4:
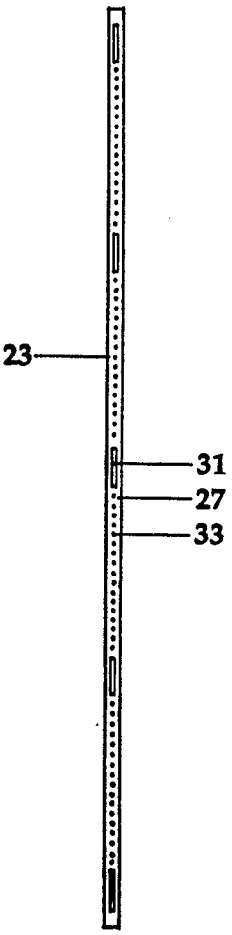
FIG. 4 is an elevation view of the support means of the invention.
Figure 15:
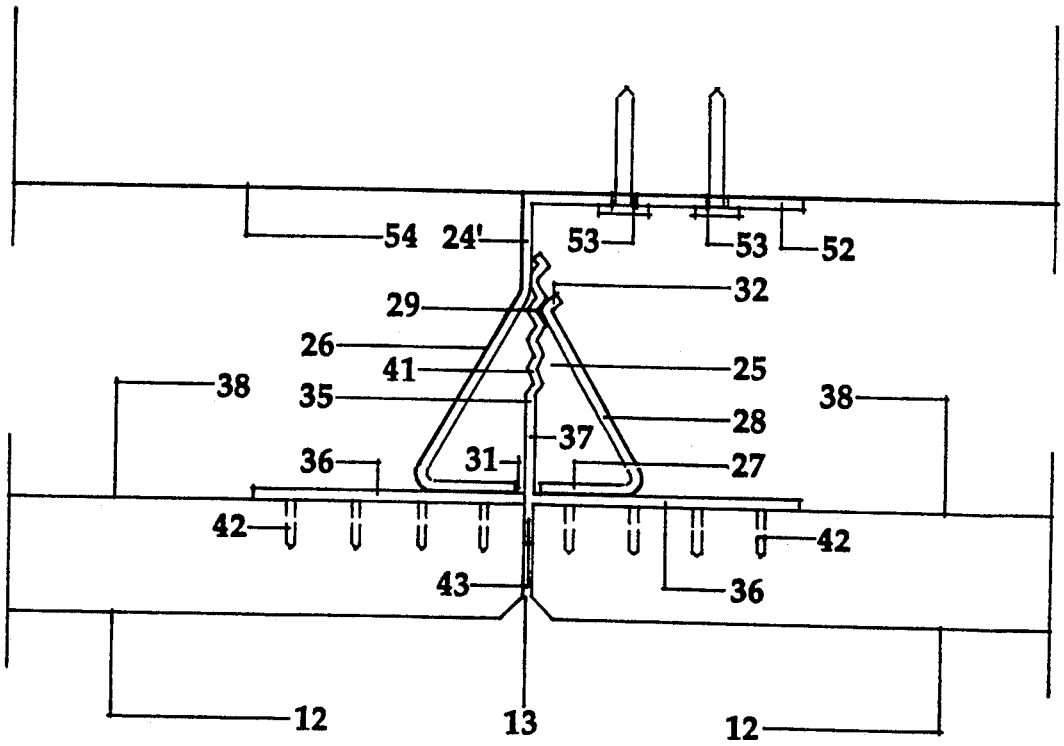
FIG. 15 is a cross-sectional view of the use of a modified support means of the invention in conjunction with a pre-existing wall structure.

It is also contemplated that the elements of the enclosure assemblies of the invention can be utilized in the construction of hollow wall partitions utilizing preexisting support means. Thus, situations will arise in which existing hollow wall partitions of conventional construction are to be removed or perhaps converted to the enclosure assembly of the invention. In such instances, it is possible that the preexisting construction was carried out using conventional metallic or wooden studs which are fixedly disposed between ceiling and floor. With the use of the elements of the invention, it is possible to erect a new hollow wall partition using a modified support means. This aspect of the invention is illustrated in FIG. 15, which is a cross-sectional view of the use of a modified support means of the building enclosure assembly of the invention for the cladding or recladding of a pre-existing wall with components of the present invention. In this case, the modified support means, as shown in FIG. 15, is defined by a shortened web portion 24' on one margin of which is formed one side portion 25, which has the identical configuration found on the support means of the invention as illustrated in FIGS. 2–4 and already discussed, supra. The opposite margin of shortened web portion 24' terminates in a flange 52, which is so formed on that margin that it lies in a plane substantially perpendicular to the plane of the shortened web portion 24'. This flange is provided with openings 53, which permit the modified support means to be attached or anchored against the pre-existing wall structure 54. The remaining components of the building enclosure assembly of the invention are then erected in exactly the same manner as has been earlier discussed, thereby forming a new wall surface with components of the present invention over the surface of a pre-existing wall structure. The modified support means may be further modified to the extent that instead of extending the full length of a given structural dimension, for example floor-to-ceiling, the support means can be of a shortened length, sufficient to exert its support and retaining effect. In such instances, in actual applications, it may be desirable or necessary to use more than one shortened modified support means per panel member joint to retain the panel members firmly against the pre-existing wall structure. Moreover, it is possible to employ the modified support means of either length configuration to create wall partitions against pre-existing wall structures with variations in the articulation of differently sized and shaped panel members to achieve aesthetically pleasing partitions.

The system of the invention can be utilized in the construction of ceilings, floors and partial height walls in precisely the same manner as has been described hereinbefore with respect to the construction of full height walls. Thus, the system can be used to construct permanent or demountable raised access flooring as well as permanent and demountable ceiling construction.

Because of the ease of erection of enclosure assemblies of the invention, it is possible to have the desired final enclosure assemblies constructed at a variety of sites. Thus, once the components are fabricated, they can be assembled on site in the field, or the components can be pre-assembled at the factory as elements. Moreover, it is fully within the contemplation of the invention that the components can be assembled at a factory into building elements or modules, which can be erected at the ultimate site as partially or totally complete building systems.

It is understood that the invention is not to be limited to the exact details of operation or structure shown and described in the specification and drawings, since obvious modifications and equivalents will be readily apparent to those skilled in the art.

What is claimed is:

1. A building enclosure assembly comprising, in combination, a plurality of floor, wall or ceiling panel members, said members having a front surface and an obverse surface; a plurality of substantially L-shaped clip attachment means comprised of a leg and a foot, where said foot is fixedly attached to the obverse surface of said panel members, and said leg, being substantially perpendicularly disposed relative to the obverse surface of the panel member and having a proximal and a distal portion relative to the point at which said leg meets said foot, where said distal portion is a corrugated continuation of said proximal portion; and a plurality of support means each formed from a single sheet of material, comprising a web portion and a laterally expanded side portion integral with and connected to a margin of said web portion, said side portion having a cross section generally describing a hollow isosceles triangle having generally equal-length legs projecting from an apex adjacent the plane of said web portion and having the base of said triangle generally perpendicular to the plane of said web portion, said base having a plurality of slots along its length, said slots lying in a plane parallel to the plane of the web and being in direct alignment with and opposite the said apex, where the clip attachment means attached to the obverse face of the panel member are so spaced along an outer edge of the panel member as to correspond in alignment with the slots in the base and with the apex of the triangle of the support means, whereby the leg of the attachment means passes through said slots and the distal corrugated portion of said leg is fixedly gripped within the apex of the triangle of the support means.

2. A building enclosure assembly of claim 1, in which said panel member is composed of gypsum fiber board.

3. The building enclosure assembly of claim 1, in which the support means is further characterized in that a side portion is connected to each of two opposite margins of said web portion.

4. The building enclosure assembly of claim 1, in which the support means is further characterized in that the equal-length legs of the triangle describing the said side portion incompletely converage at the apex of said triangle, whereby there is defined an opening at said apex, where said opening has a lateral dimension narrower than the lateral dimension of the slots in the base of said triangle.

5. The building enclosure assembly of claim 4, wherein the support means is characterized in that a side portion having the said opening in the apex of the triangle is connected to each of two opposite margins of said web portion.

6. The building enclosure assembly of claim 1, wherein the substantially L-shaped clip attachment means is characterized in that the foot and leg thereof are one integral unit.

7. The building enclosure assembly of claim 1, wherein the substantially L-shaped clip attachment means is characterized in that the leg and foot are separate elements of said attachment means, with the leg adapted to be fixedly retained by the foot.

8. The building enclosure assembly of claim 1, wherein the leg of said clip attachment means further has an extension, which extension lies in the same plane as said leg and which extends in a direction substantially opposite from the leg from the point at which the leg meets the foot, where said extension aligns with and bears against the outer edge of the panel member.

9. The building enclosure assembly of claim 8, wherein the leg extension seats into and bears against a recess formed into the outer edge of the panel member.

10. The building enclosure assembly of claim 1, wherein the support means are fixedly maintained in proper vertical and/or horizontal alignment and spacing arrangement by means of 90° brackets having two legs, one leg adapted to be inserted into and gripped within the apex or apices of the support means and the other leg attached to a fixed building structural member.

11. The building enclosure assembly of claim 10, wherein the support means are disposed between and are attached to track means by use of the 90° brackets, said track means being attached to fixed building structural members.

12. The building enclosure assembly of claim 1, wherein the support means has integrally formed on one margin of the web portion a laterally expanded side portion, and on the opposite margin of the web portion there is formed a flange which lies in a plane substantially perpendicular to the plane of the web portion.

13. A building enclosure assembly comprising, in combination, a plurality of gypsum wallboard floor, wall or ceiling panel members; a plurality of support means each formed from a single sheet of material, comprising a web portion and a laterally expanded side portion integral with and connected to a margin of said web portion, said side portion having a cross section generally describing a hollow isosceles triangle having generally equal-length legs projecting from an apex adjacent the plane of said web portion and having the base of said triangle generally perpendicular to the plane of said web portion, said base having a plurality of slots along its length, said slots lying in a plane parallel to the plane of the web and being in direct alignment with and opposite the said apex; and a plurality of 90° brackets having two legs, one leg inserted into and gripped within the apex of the support means and the other leg attached to a fixed building structure member wherein the support means and the 90° brackets are erected to form a framework to which are attached gypsum wallboard panels, said panels being attached to said framework by use of attachment means which are fixedly retained within the laterally expanded side portion of the support means.

* * * * *